United States Patent [19]

Sokolovsky

[11] Patent Number: 4,683,023

[45] Date of Patent: Jul. 28, 1987

[54] TAPE ATTACH MACHINE

[75] Inventor: Paul J. Sokolovsky, Sunnyvale, Calif.

[73] Assignee: Advanced Micro Devices, Inc., Sunnyvale, Calif.

[21] Appl. No.: 836,941

[22] Filed: Mar. 6, 1986

[51] Int. Cl.[4] ..... B32B 31/04

[52] U.S. Cl. ..... 156/518; 158/521; 158/530; 158/567; 156/521; 156/530; 156/567

[58] Field of Search ..... 156/518, 519, 520, 521, 156/530, 567

[56] References Cited

U.S. PATENT DOCUMENTS

| | | | |
|---|---|---|---|
| 1,809,341 | 6/1931 | Jensen . | |
| 2,627,212 | 2/1953 | Connor et al. | 93/1 |
| 4,181,554 | 1/1980 | Rich | 156/261 |
| 4,214,944 | 7/1980 | Lemke | 156/518 |
| 4,279,682 | 7/1981 | Hamagami et al. | 156/518 |
| 4,355,719 | 10/1982 | Hinds et al. | 206/334 |
| 4,518,096 | 4/1986 | Sato | 156/518 |

*Primary Examiner*—Caleb Weston

*Attorney, Agent, or Firm*—Patrick T. King; James M. Heslin

[57] ABSTRACT

A machine for applying an adhesive pad to the ends of semiconductor device packages includes a punch assembly, a tape feed assembly, and a package feed assembly. The tape is incrementally fed to the punch assembly where semiconductor packages are individually brought into alignment. The punch assembly first shears an adhesive pad from the tape and thereafter applies the pad to the package. The punch member of the punch assembly includes a resilient tip which assures that the tape is securely attached to the package and helps prevent damage to the package. Semiconductor device packages having such taped ends are less likely to be damaged in subsequent processing and handling.

7 Claims, 6 Drawing Figures

TAPE ATTACH MACHINE

BACKGROUND OF THE INVENTION

1. Field of the Invention

The present invention relates generally to the packaging of semiconductor devices and, more particularly, to a machine for attaching a protective barrier on the ends of elongate semiconductor packages.

Semiconductor devices, such as integrated circuits or "chips", are packaged or assembled in several different manners. Typically, the integrated circuit is encapsulated in a plastic or ceramic "package" having lead connectors extending from the sides. The most common package, referred to as the dual in-line package or DIP, is a small rectangular box having a plurality of leads on two sides thereof.

After assembly, DIPs are frequently transported in carrier tubes to various locations for post-assembly processing, testing, marking, and the like. In the carrier tubes, the DIPs are aligned along their elongate axes with the external leads running in channels or tracks. The DIPs are impelled through the carrier tubes causing physical contact (bumping) between adjacent DIPs. Such contact can cause chipping and cracking of the package, particularly with ceramic packages which are very brittle.

It would thus be desirable to provide a technique for protecting individual semiconductor packages from damage resulting from mechanical shock arising from such handling techniques.

2. Description of the Relevant Art

Presently, semiconductor device packages are protected from mechanical shock by manually applying a piece of tape on one or both ends of the device which are exposed to contact with other devices in carrier tubes. Although this method provides adequate protection, the manual technique for applying the tape is time-consuming and costly. U.S. Pat. No. 4,355,719 to Hinds et al. discloses a semiconductor device package having resilient polymeric beads applied onto the end(s) thereof. The patent does not disclose the manner of applying the beads.

SUMMARY OF THE INVENTION

The present invention provides an apparatus for automatically applying a layer of an adhesive material or tape onto the end of semiconductor device packages to protect the package from mechanical shock during subsequent transport and processing. The apparatus comprises a mechanism for feeding a continuous ribbon of the material to a punch assembly. The punch assembly includes three elements: a die, a shearing member for cutting a section of the adhesive material and a shaft for applying that section to the semiconductor device. The shaft includes a resilient tip having a preselected hardness which conforms to the end of the package and assures that the adhesive material is securely applied. The apparatus also includes a support mechanism which holds the semiconductor device in alignment with the punch. The tape is directed in front of the die, and the punch assembly is able to shear a section of the tape and apply that section to the semiconductor device package in a single stroke. In the preferred embodiment, the support mechanism includes an automatic feeding means which feeds individual packages into alignment with the punch in registration with the mechanism for actuating the punch. In this way, tape can be applied to individual packages in a rapid and low cost manner.

DESCRIPTION OF THE PREFERRED EMBODIMENT

Figure 1:
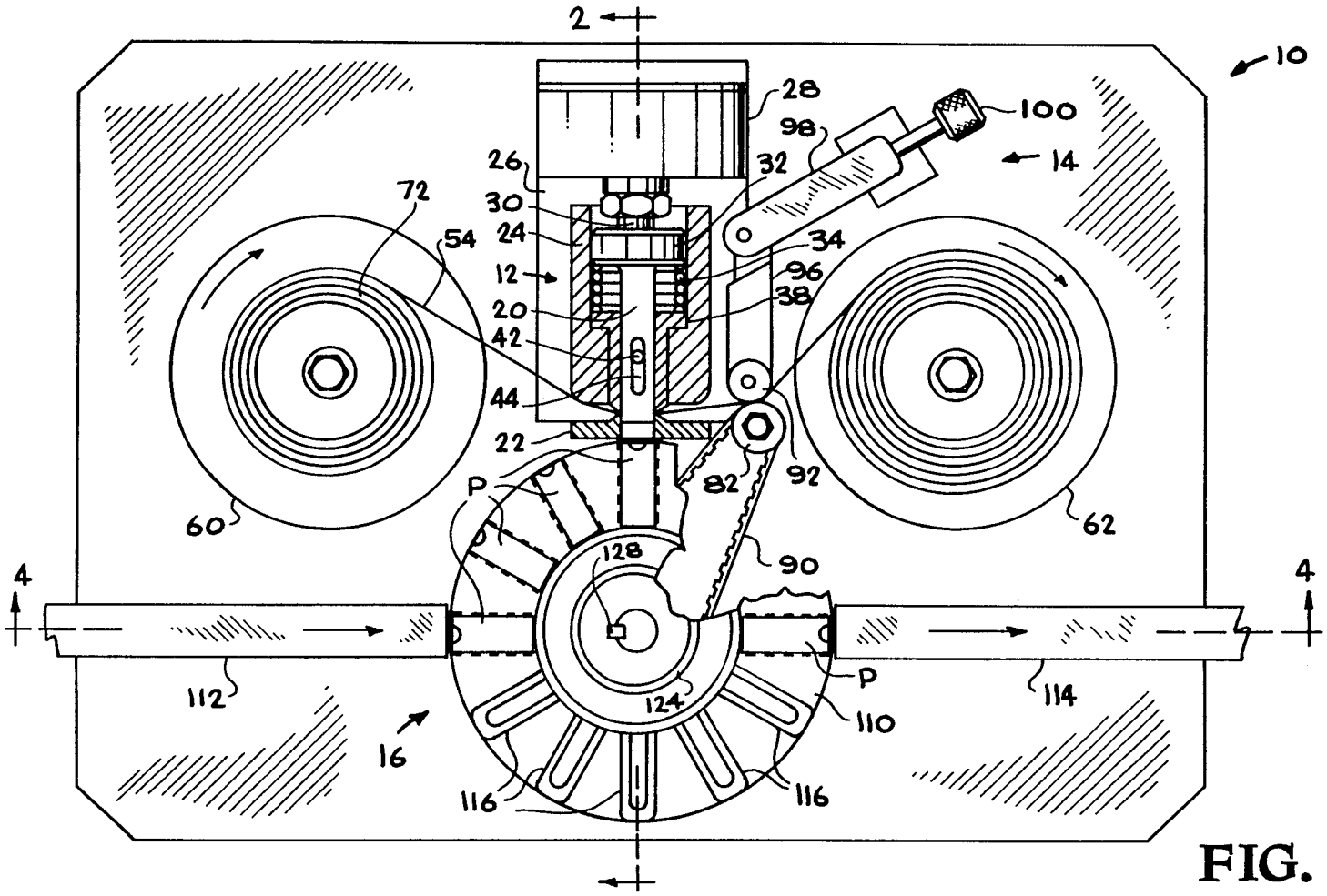
FIG. 1 is a top view of the apparatus of the present invention with portions broken away.
Figure 2:
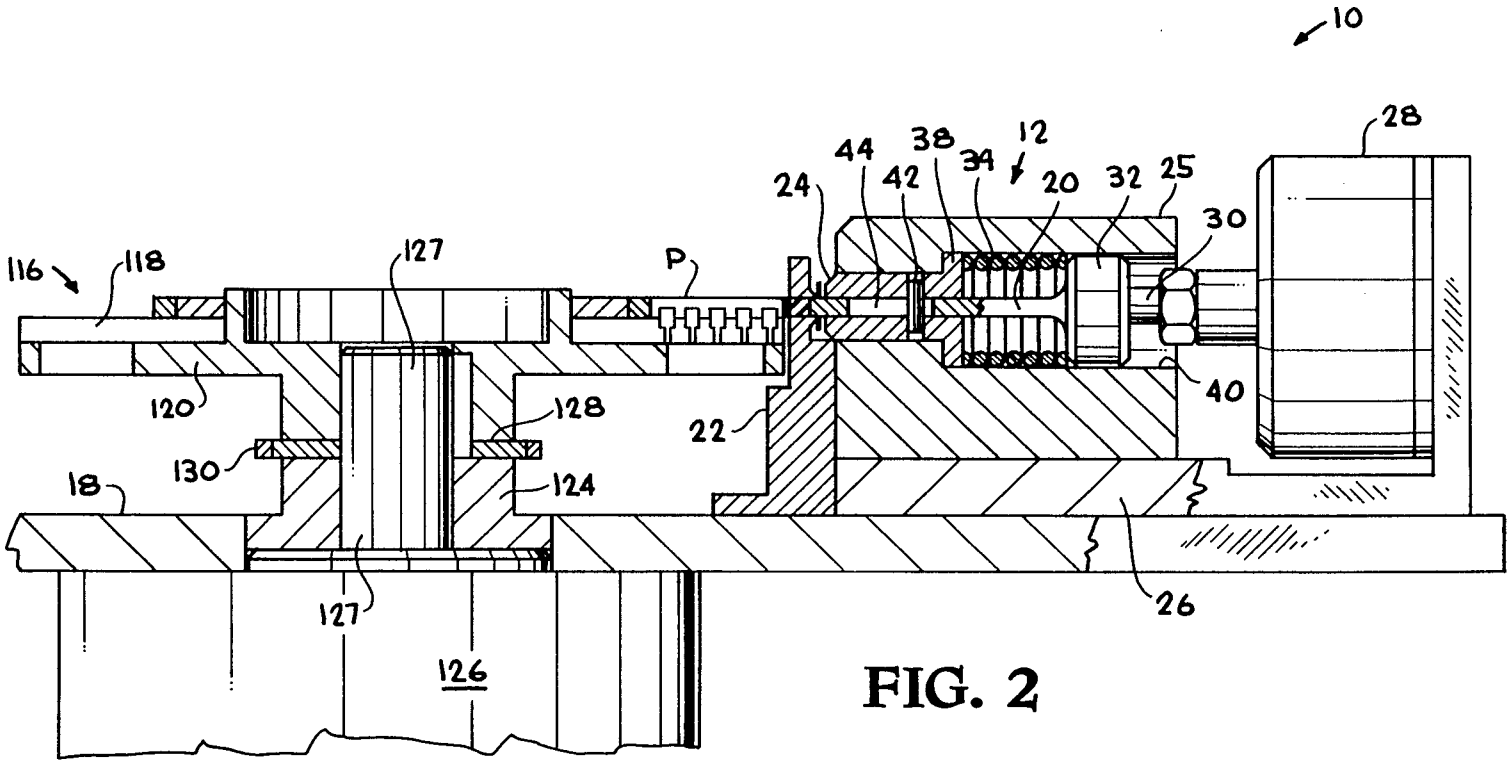
FIG. 2 is a sectional view taken along line 2—2 of FIG. 1.

Referring to FIGS. 1-5, a tape attach machine 10 constructed in accordance with the principles of the present invention will be described. The tape attach machine 10 includes a punch assembly 12, a tape feed assembly 14, and an assembly 16 for feeding individual dual in-line (DIP) packages to the punch assembly where individual segments or pads of the tape are die cut and applied to the end of the DIP. The various assemblies are mounted on a common base plate 18. Each of these assemblies will now be described in detail.

Referring in particular to FIGS. 1, 2, 3A and 3B, the punch assembly 12 comprises a shaft 20 and a die plate 22. The shaft 20 is mounted to reciprocate in axial passage 23 of shearing member 24. The shearing member 24 is reciprocably mounted in a block 25 which, in turn, is mounted on bracket 26. The bracket is mounted on the base plate 18.

The punch assembly 12 is powered by a pneumatic piston 28 having a drive rod 30 projecting therefrom. The drive rod 30 contacts a plug 32 attached at the rear (i.e., to the right in FIG. 2) of the shaft 20. A spring 34 extends between the plug 32 of the shaft 20 and a flange 38 formed in the rearward end of the shearing member 24. The shaft 20 is thus free to slide in axial passage 23 of shearing member 24 with the plug 32 travelling in a larger diameter bore 40 formed in block 25.

Figure 3A:
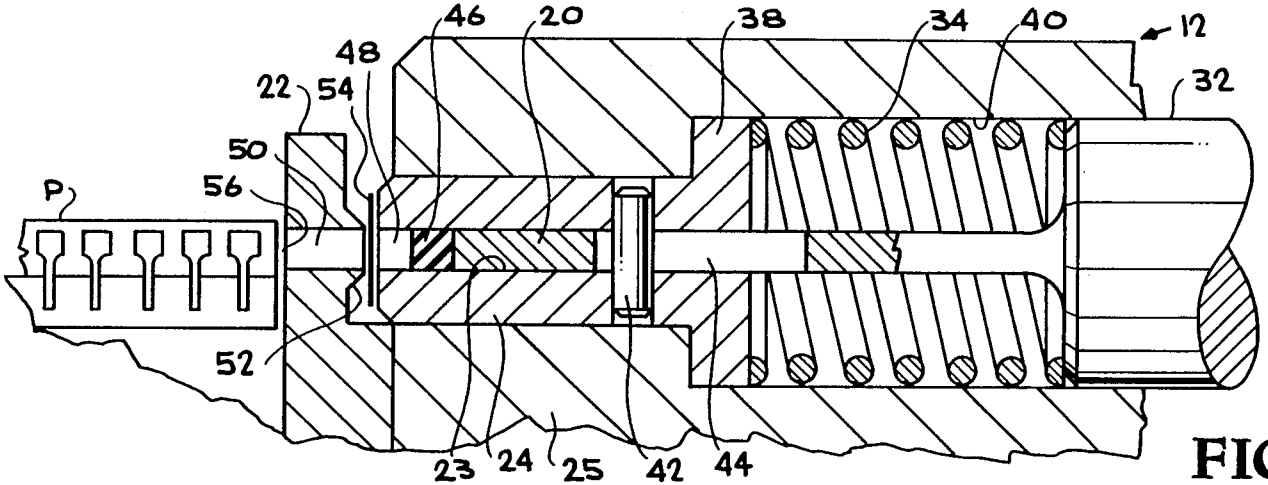
FIGS. 3A and 3B are detailed views of the punch mechanism of the present invention.
Figure 3B:
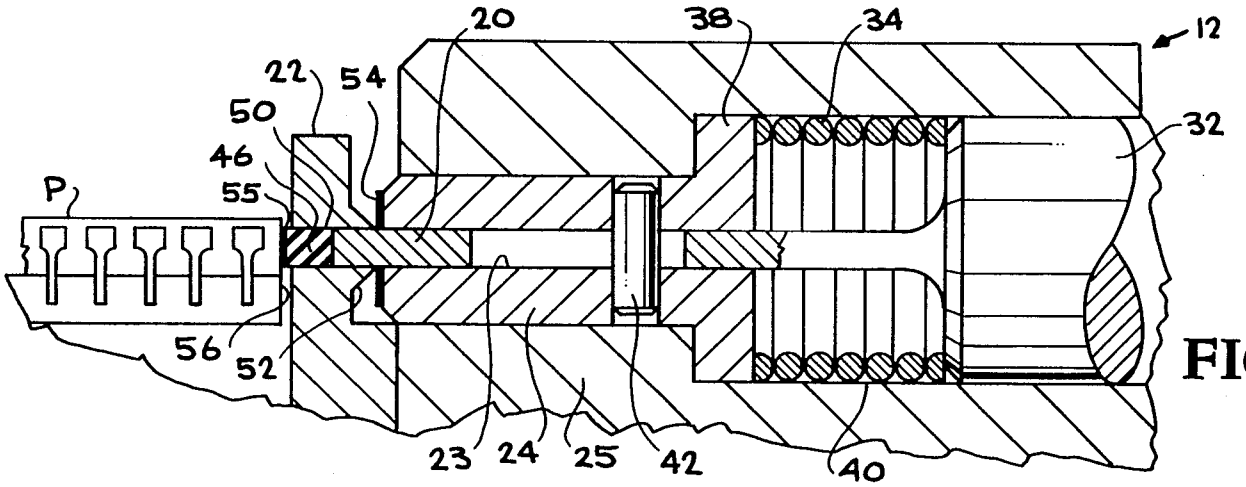

Moreover, shearing member 24 is free to slide in bore 40 of block 25. The travel of shearing member 24 is dictated by spring 34 which extends between flange 38 and plug 32. When piston 28 is fully retracted, as illustrated in FIG. 3A, spring 34 is relaxed and shearing member 24 is drawn into block 25. This leaves a clearance between the forward end (to the left in FIGS. 3A and 3B) of the shearing member 24 and the die plate 22. When the piston 28 is extended to the left (as illustrated in FIG. 3B), spring 34 causes shearing member 24 to move fully forward in bore 40 so that the forward end of the shearing member just contacts the die plate 22. In this way, the shearing member 24 and die plate 22 are able to cut a section of adhesive material for application to the semiconductor device, as will be described more fully hereinafter.

The travel of the shaft 20 in shearing member 24 is limited by a pin 42 received in slot 44 formed therein. In FIG. 3A, the shaft 20 is retracted with its forward tip 46 lying behind (to the right of) forward opening 48 of axial bore 23. FIG. 3B illustrates the shaft 20 in its fully extended configuration.

The die plate 22 includes a die port 50 which is aligned with the forward opening 48 of shearing member 24. The die plate 50 includes a honed boundary 52 to assist in shearing the tape by shearing member 24. The cross-sectional shape of the die port 50 and boundary 52 are identical and chosen to correspond to the peripheral shape of the shaft 20. Such cross-sectional shape will, of course, determine the shape of the tape which is cut out and applied to the DIP. Conveniently, the shape will be rectangular having dimensions slightly smaller than those of the DIP.

The forward opening 48 of the shearing member 24 and the honed boundary 52 of die port 50 are spaced apart a distance sufficient (in the relaxed configuration of FIG. 3A) to allow passage of an adhesive material therebetween. The adhesive material is typically a ribbon of adhesive tape 54 having sufficient thickness and compressibility to absorb mechanical shock when placed on the end of a semiconductor device package. The nature of the tape is not critical. A suitable tape is 5 mil Teflon ® tape, such as Permacel ® tape available from Permacel Corp., New Brunswick, N.J.

As will be descrrbed in greater detail hereinafter, a semiconductor package P is held on the DIP feed assembly 16 in alignment with the shaft 20 and die port 50. Thus, as the shaft 20 is driven forward (i.e., to the left in FIGS. 2, 3A and 3B), a pad or section 55 (FIG. 3B) of the tape 54 is sheared as forward end of shearing member 24 contacts honed boundary 52 of die port 50. As the shaft 20 emerges from the shearing member 24, the pad 55 of tape is carried on the forward tip 46 until it reaches end 56 of the package P. FIG. 3B illustrates shaft 20 in its forwardmost (i.e., to the left in FIG. 3B) position with forward tip 46 urged against end 56 of the package P.

In order to assure that the pad 54 of adhesive tape is properly applied to the package P, the forward tip 46 of the shaft 20 is formed from a resilient material. Such resilient material will deform when pressed against package P, assuring that pressure is evenly applied on the adhesive pad. The resilient tip 46 also helps prevent damage to the semiconductor device from the tape attach machine 10 itself. The tip 46 should have a durometer hardness in the range from about 60 to 90 with a thickness of about 0.02 to 0.05 inch. The preferred tip 46 will be an elastomer having a durometer hardness of 80 and a thickness of 0.03 inch. It is an important aspect of the present invention that the shearing of the pad 55 is accomplished solely by the shearing member 24 and the honed boundary 52 of die port 50. In this way, wear on the resilient forward tip 46 is minimized and the shearing action is improved.

It is also desirable to limit the force applied by the pneumatic piston 28 and transmitted through the shaft 20. To this end, a proper balancing of the spring force of spring 34 will help offset the net force applied to the semiconductor package P. It is best to limit the striking force to about 10 psi or less.

Figure 4:
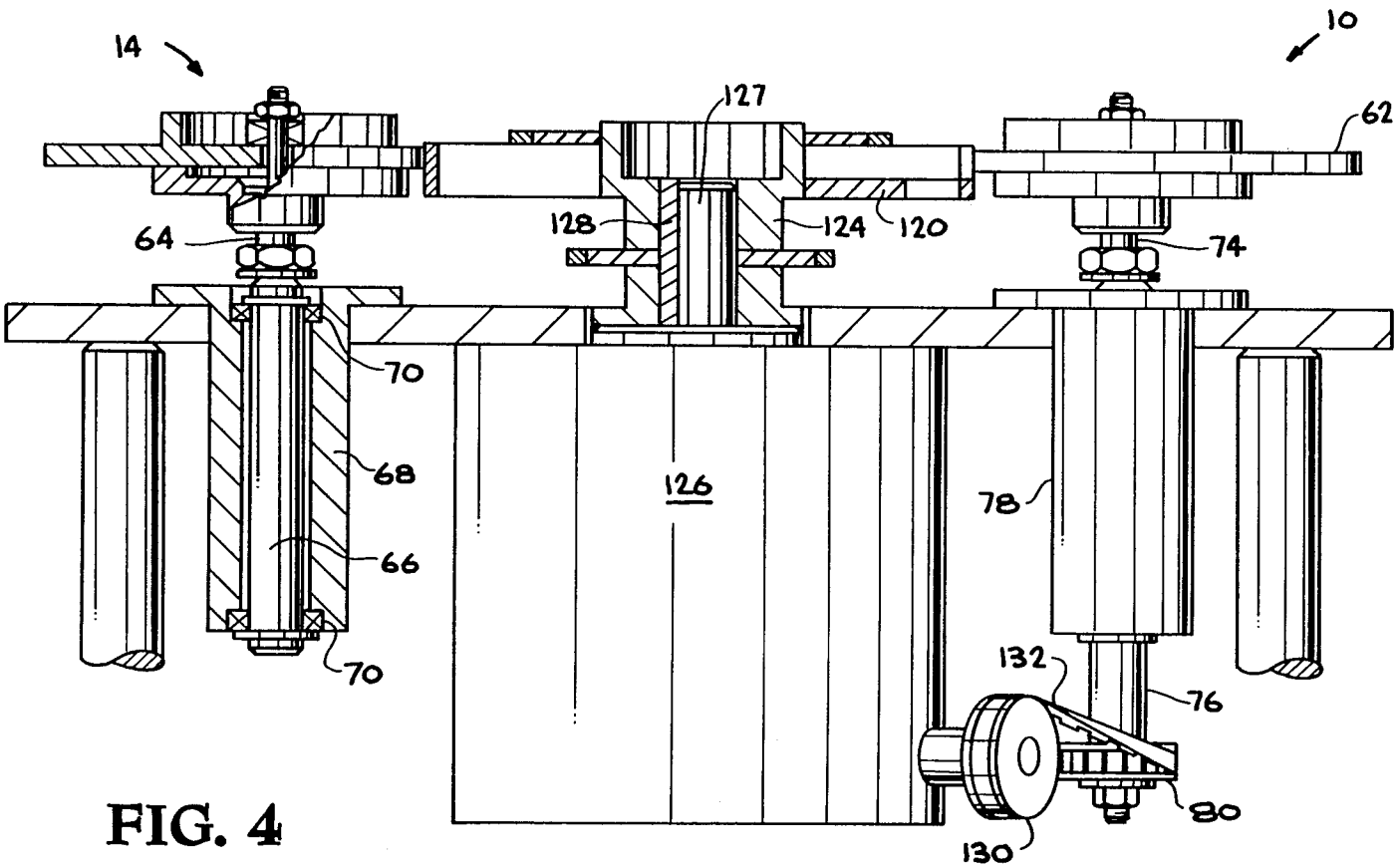
FIG. 4 is a sectional view taken along line 4—4 of FIG. 1.

Referring now in particular to FIGS. 1 and 4, the tape feed assembly 14 will be described. Assembly 14 comprises a tape feed spool 60 and tape take-up spool 62. Feed spool 60 is mounted on a shaft 64 which is received a spindle 66. Spindle 66, in turn, is rotatably received in bearing member 68 having a ring bearings 70 at its upper and lower ends. The feed spool 60 carries a roll of tape 72 (FIG. 1) on its upper surface. The spool 60 is rotated as tape is withdrawn by the take-up spool 62, as will be described hereinafter.

The take-up spool 62 is similarly mounted on a shaft 74 which is received in a spindle 76. The spindle is rotatably mounted in a bearing member 78 which includes a sprocket 80 at its lower end. As will be explained hereinafter, the sprocket is positively driven by the motor which rotates the package feed assembly 16.

Figure 5:
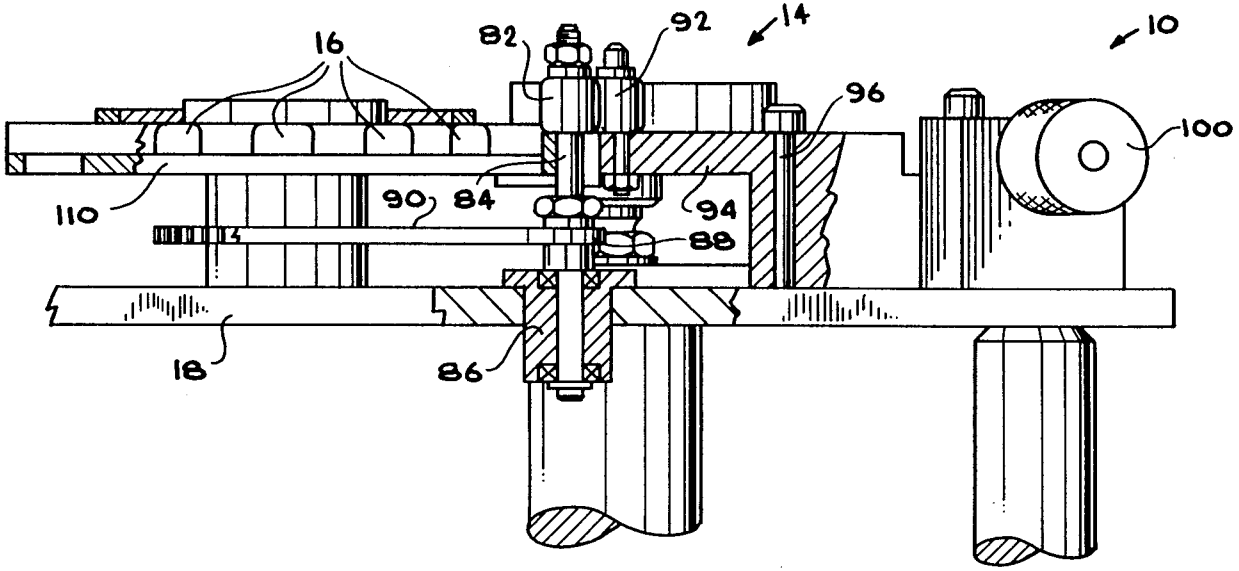
FIG. 5 is a side elevational view of the apparatus illustrating the capstan linkage.

Referring now also to FIG. 5, a capstan 82 is mounted on a shaft 84 which is received in a bearing member 86 mounted on base plate 18. A sprocket 88 is secured about the shaft 84 and driven by a timing belt 90 which in turn is driven by the package feed assembly 16. An idler wheel 92 is mounted on arm 94 and bears against the capstan 82. Arm 94 is pivotally mounted on pin 96 and attached at its remote end to a connector arm 98 (FIG. 1). Connector arm 98 can be axially translated by knob 100, and rotation of knob 100 thus adjusts the tension of idler wheel 92 against the capstan 82.

Referring now in particular to FIG. 1, tape 54 exits the tape feed spool 60 and enters a slot formed between die plate 22 and block 25. The tape 54 passes in front of the honed boundary 52 of the die plate and thereafter exits the slot where it passes between the capstan 82 and idler wheel 92. The tape is then taken up by take-up spool 62 in a conventional manner. The rate at which the tape passes through the punch assembly 12 is determined by the capstan 82. The rate will be sufficient to assure that a new section of tape is available as each DIP P is processed by the machine, positioned at a 35 degree angle for gravity-fed input and output.

The package feed assembly 16 includes a carousel 110 mounted intermediate an inlet transfer tube 112 and an outlet transfer tube 114. The tubes, being inclined at 35 degrees, serve as conveyors for the DIP packages. The inlet transfer tube carries individual DIP packages to the carousel 110 and feeds them singly onto stations 116. Each station 116 includes a pair of parallel walls 118 which project upward from base plate 120 of the carousel 110. The DIPs are fed so that the DIP leads extend over the outer edges of the walls 118 while the ceramic package itself is supported on top of the walls. Stations 116 are arranged to support the packages P radially so that one end of each package lies substantially tangentially to the periphery of the carousel 110.

Referring to FIGS. 1 and 4, the carousel 110 is mounted on a pedestal 124 which in turn is mounted on a stepping motor (not shown) located in enclosure 126. The stepping motor drives an output shaft 127 which includes a key 128. The output shaft 127 drives the base plate 120 of the carousel 110 and a sprocket 129 mounted between the base plate 120 and the pedestal 124. The pedestal 124 is not rotated by the shaft 127. The stepping motor may be electric or pneumatic and is arranged to advance the carousel 30° at a time so that each station 116 can be brought into alignment with the punch assembly 12.

Output transfer tube 114 is arranged to receive the packages P after the adhesive pads have been applied by the punch assembly 12. As illustrated, the output tube 114 is mounted opposite the input transfer tube 112 so that the packages are removed after advancing 180° on the carousel 110. The construction of the output transfer tube 114 is conventional and will not be described further.

Sprocket 129 receives the timing belt 90 which drives capstan 82 described above. The relative diameters of sprocket 129 and sprocket 88 are chosen to provide the desired incremental advance for the tape 54.

Similarly, the stepping motor drives a second sprocket 130 located on the side of enclosure 126. A timing belt 132 extends between sprocket 130 and sprocket 80 located at the bottom of spindle 76. In this way, the take-up spool 62 is driven forward to collect the tape 54 as it is released by capstan 82.

Although the foregoing invention has been described in some detail by way of illustration and example for purposes of clarity of understanding, it will be obvious that certain changes and modifications may be practiced within the scope of the appended claims.

What is claimed is:

1. An apparatus for applying adhesive material onto the end of a semiconductor device package, said apparatus comprising:

a punch assembly mounted to reciprocate along a straight horizontal line, said punch assembly including a shearing member and a shaft having a resilient tip;

an inlet conveyor which moves the semiconductor device packages end-to-end;

a carousel which receives the packages singly from the inlet conveyor and rotates the packages into horizontal aligment with the punch;

an outlet conveyor which receives the packages singly and moves them end-to-end from the carousel;

a die having a port with dimensions sufficient to receive the shaft therethrough;

means for feeding a ribbon of adhesive material between the punch assembly and the die; and means for reciprocating the punch assembly so that the shearing member contacts the die to cut the layer from the ribbon, and thereafter the shaft applies said layer to the end of the semiconductor device.

2. An apparatus as in claim 1, wherein the resilient tip of the punch has a durometer hardness in the range from 60 to 90 and a thickness in the range from 0.02 to 0.05 inch.

3. An appratus for applying adhesive material onto the end of a semiconductor device package, said apparatus comprising:

means for translating the packages along a predefined path;

a punch assembly located along the path, said punch assembly including a shaft having resilient tip with a durometer hardness in the range from 60 to 90 and a thickness in the range from 0.02 to 0.05 inch, and a shearing member mounted coaxially about the shaft, where the relative axial movement of the shaft and the shearing member is limited by a spring;

a die plate aligned with the punch assembly and having a port capable of shearingly mating with the shearing member and being sufficiently large to receive the shaft member therethrough;

means for feeding a ribbon of adhesive material between the punch assembly and the die plate; and means for reciprocating the punch assembly so that the shearing member is urged against the die plate by the spring to shear the adhesive material while the shaft travels through the port to carry the sheared adhesive material to the package.

4. An apparatus as in claim 3, wherein the means for translating is a carousel.

5. An apparatus as in claim 3, wherein the die plate includes a honed boundary which mates with the shearing member.

6. An apparatus as in claim 5, wherein the shaft is recessed within an axial passage within the shearing member when the spring of the punch assembly is relaxed.

7. An apparatus as in claim 5, wherein the honed boundary is coextensive with the periphery of the port.

* * * * *